United States Patent [19]

Sherlock et al.

[11] Patent Number: 4,953,851

[45] Date of Patent: Sep. 4, 1990

[54] SAFETY MOBILIZER WALKER

[76] Inventors: Lila A. Sherlock, 280 Collins Ave., Mt. Vernon, N.Y. 10552; Maryann P. Finn, 246-31 137th Rd., Rosedale, N.Y. 11442

[21] Appl. No.: 268,035

[22] Filed: Nov. 7, 1988

[51] Int. Cl.[5] ..... A61H 3/00

[52] U.S. Cl. ..... 272/70.3; 297/6

[58] Field of Search ..... 272/70, 70.3, 70.4; 297/5, 6, 274, 275, 441, 8; 135/65, 67; 280/87.02 R, 87.02 W

[56] References Cited

U.S. PATENT DOCUMENTS

| | | | |
|---|---|---|---|
| 207,698 | 9/1878 | Want | 297/6 |
| 2,852,066 | 9/1958 | Hawkins | 297/275 |
| 4,272,071 | 6/1981 | Bolton | 272/70.4 |
| 4,342,465 | 8/1982 | Stillings | 135/67 X |
| 4,621,804 | 11/1986 | Mueller | 272/70.3 |

FOREIGN PATENT DOCUMENTS

| | | | |
|---|---|---|---|
| 136885 | 3/1934 | Fed. Rep. of Germany | 135/65 |

*Primary Examiner*—Richard J. Apley
*Assistant Examiner*—H. Flaxman
*Attorney, Agent, or Firm*—Michael I. Kroll

[57] ABSTRACT

A safety mobilizer walker is provided and consists of a curved arm member hinged at one end to a C-shaped rim member and can be secured at free end in a closed position to the rim member forming an O-shaped configuration. Four vertical support legs are spaced about and affixed to the rim member while four brace members are affixed diagonally between the support legs to form two X-shaped frames for stabilizing the support legs. A wheel assembly is mounted to bottom of each support leg so that a disabled person can enter the rim member, close the arm member and be supported therein when moving about. A sling seat is also provided so that the disabled person can sit within the sling seat and be supported therein when moving about.

6 Claims, 1 Drawing Sheet

SAFETY MOBILIZER WALKER

BACKGROUND OF THE INVENTION

1. Field of the Invention

The instant invention relates generally to supportive devices and more specifically it relates to a safety mobilizer walker.

2. Description of the Prior Art

Numerous supportive devices have been provided in prior art that are adapted to give mobility to disabled people. The supportive devices can be wheelchairs, canes, crutches, braces, walkers and the like. While these units may be suitable for the particular purpose to which they address, they would not be as suitable for the purposes of the present invention as heretofore described.

SUMMARY OF THE INVENTION

A primary object of the present invention is to provide a safety mobilizer walker that will overcome the shortcomings of the prior art devices.

Another object is to provide a safety mobilizer walker which has four wheels and will support a disabled person sitting in a sling seat suspended within the walker so that the disabled person can move the walker thereabout.

An additional object is to provide a safety mobilizer walker that is height adjustable for various sized disabled people.

A further object is to provide a safety mobilizer walker that is simple and easy to use.

A still further object is to provide a safety mobilizer walker that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4:
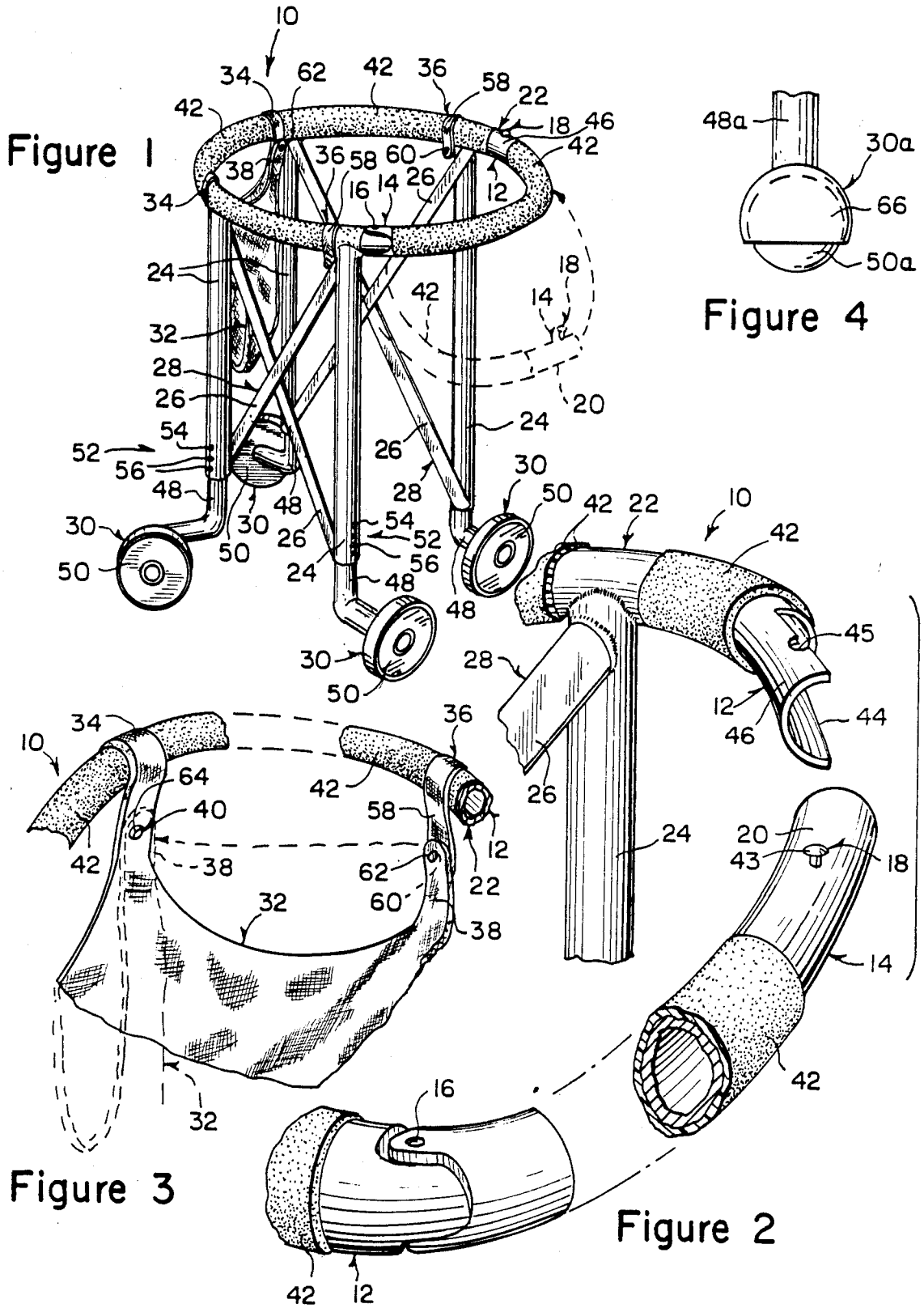
FIG. 1 is a perspective view of the invention with the curved arm member in a closed position and the sling seat in a folded position.
FIG. 2 is an enlarged perspective view of upper portion of the walker with parts broken away showing the curved arm member in greater detail.
FIG. 3 is an enlarged perspective view of the upper portion of the walker with parts broken away showing the sling seat in an operable position.
FIG. 4 is an elevational view of one of the wheel assemblies being of a ball bearing type.

Turning now descriptively to the drawings, in which similar reference characters denote similar elements throughout the several views, FIGS. 1 through 3 illustrate a safety mobilizer walker 10 which includes a C-shaped rim member 12. A curved arm member 14 is hinged at one end 16 to the rim member 12. A structure 18 is provided for securing the arm member 14 at free end 20 in a closed position to the rim member 12 forming an 0-shaped configuration 22. Four vertical support legs 24 are spaced about and affixed to the rim member 12. Four brace members 26 are affixed diagonally between the support legs 24 to form two X-shaped frames 28 for stabilizing the support legs 24. Four wheel assemblies 30 are also provided, in which each is mounted to bottom of each of the support legs 24 so that a disabled person (not shown) can enter the rim member 12, close the arm member 14 and be supported therein when moving about.

A sling seat 32 is suspended from first side 34 to the rim member 12. A structure 36 is for suspending the sling seat 32 from second side 38 to the rim member 12 in an open position so that the disable person can sit within the sling seat 32 and be supported therein when moving about. Another structure 40 is for suspending the sling seat 32 in a folded position onto itself so that the disable person can stand within the walker 10 and be supported therein when moving about.

A resilient covering 42 is placed over the rim member 12 and the arm member 14 for protecting the disabled person.

The arm member securing structure 18 includes a rivet pin 43 carried on top of free end 20 of the curved arm member 14. The rim member 12 has a cutout area 44 with top notch 45 in distal end 46 thereof to receive the rivet pin 43 when the free end 20 of the curved arm member 14 enters the cutout area 44 in the distal end 46 of the rim member 12.

Each of the wheel assemblies 30 includes an L-shaped extendable leg member 48 slideably disposed into bottom of one of the support legs 24. A wheel 50 is rotatably affixed to end of the leg member 48. A mechanism 52 is for locking the leg member 48 to the support leg 24 in any one of a number of vertical positions thereto.

The leg member locking mechanism 52 includes a detent 54 formed on the leg member 48 while the support leg 24 has a plurality of vertically spaced apart holes 56 in which any of the holes 56 can receive the detent 54 when the leg member 48 is slideably disposed into bottom of the support leg 24.

The sling seat open position suspending structure 36 includes a pair of support straps 58, each suspended from opposite side of the rim member 12. A pair of female snaps 60 are each affixed to one of the support straps 58. A pair of male snaps 62 are each affixed to the second side 38 of the sling seat 32 so that when the sling seat 32 is placed in the open position the male snaps 62 will attach to the female snaps 60.

The sling seat folded position suspending structure 40 includes a second pair of female snaps 64 that are each affixed to the first side 34 of the sling seat 32 so that when the sling seat 32 is placed into the folded position the male snaps 62 will attach to the second female snaps 64.

FIG. 4 shows an alternate wheel assembly **30*a* that includes a ball bearing wheel 50*a* carried in a bearing enclosure 66 on modified leg member 48*a***.

LIST OF REFERENCE NUMBERS

10 safety mobilizer walker
12 C-shaped rim member
14 curved arm member
16 hinge end of curved arm member
18 securing structure
20 free end of curved arm member
22 O-shaped configuration 24 vertical support leg
26 brace member
28 X-shaped frame
30 wheel assembly
30a alternative wheel assembly
32 sling seat
34 first side of sling seat
36 open position structure
38 second side of sling seat
40 folded position structure
42 resilient covering
43 rivet pin
44 cutout area
45 top notch
46 distal end of rim member
48 L-shaped extendable leg member
48a modified leg member
50 wheel
50a ball bearing wheel
52 locking mechanism
54 detent on the leg member
56 hole in support leg
58 support strap
60 female snap
62 male snap
64 female snap
66 bearing enclosure It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A safety mobilizer walker which comprises:
(a) a generally circular shaped rim member having a stationary portion and allowing user to grip said generally circular shaped rim member during an atoxia attack, a vertigo attack, or fatigue until help arrives;
(b) a curved arm member hinged at one end to said generally circular rim member;
(c) means for securing said arm member at its free end in a closed position to said generally circular rim member and forming an "O"-shaped configuration, said arm member securing means including a rivet pin carried on top of said free end of said curved arm member and said generally circular rim member having a cutout area with topnotch in distal end thereof to receive said rivet pin when free end of said curved arm member swings into said cutout area in said distal end of said generally circular rim member, said cut out area contained in said free end of said fixed member to assist in connecting said free end of said fixed member with said free end of said curved arm member while said fixed end remains pivotable in a plane defined by said generally circular rim member, since said generally circular rim member and said curved arm member are substantially curved and only said curved arm member is disposed pivotally in the same plane as said generally circular rim member the connection can only be achieved by pivotable means so that said free end of said curved arm member swings into said free end of said generally circular rim member;
(d) four vertical support legs spaced about and affixed to said stationary portion of said generally circular rim member;
(e) four brace members affixed diagonally between said support legs to form two X-shaped frames for stabilizing and for preventing torsional deformation and shear stress of said support legs;
(f) four wheel assemblies, each mounted to bottom of each of said support legs and having adjustment means to adjust height of said generally circular rim member without having to remove any members so that a disabled person can enter said generally circular rim member, close said arm member and be supported therein when moving about;
(g) a non-rigid sling seat having a second side and a first side, said first side being disposed on and removably suspended from said generally circular shaped rim member, said sling being readily adjustable while being removably attached at said first end and said second end to said generally circular shaped rim member so that said sling is readily removed for cleaning incontinence accidents, in addition to the normal cleaning, and repairing;
(h) means for removably suspending said sling seat from said second side said sling seat being disposed on said generally circular shaped rim member and said sling seat being in an open position so that the disabled person can sit within said sling seat which is in said opened position and be supported therein when moving about; and
(i) means for suspending said sling seat in a folded position onto itself so that the disabled person can stand within said walker and be supported therein when moving about.

2. A safety mobilizer walker as recited in claim 1, further including a resilient covering placed over said generally circular shaped rim member and said curved arm member for protecting the disabled person.

3. A safety mobilizer walker as recited in claim 3, wherein each of said wheel assemblies is adjustable and includes an L-shaped extendable leg member slideably disposed into the bottom of one of said support legs, a wheel rotatably affixed to the end of said leg member, and means for locking said leg member to said support leg in any one of a number of vertical positions thereto sop that the height of said generally circular rim member is adjustable.

4. A safety mobilizer walker as recited in claim 3, wherein said leg member locking means includes:
(a) a detent formed on said leg member; and
(b) said support leg having a plurality of vertically spaced apart holes in which any of said holes can receive said detent when said leg member is slideably disposed into bottom of said support leg.

5. A safety mobilizer walker as recited in claim 4, wherein said sling seat open position suspending means includes a pair of support straps, each suspended from said fixed portion of said generally circular rim member, a pair of female snaps, each affixed to one of said support straps, and a pair of male snaps, each affixed to said second side of said sling seat so that when said sling seat is placed in the open position said male snaps will attach to said female snaps.

6. A safety mobilizer walker as recited in claim 5, wherein said sling seat folded position suspending means includes a second pair of female snaps, each affixed to said first side of said sling seat so that when said sling seat is placed into the folded position said male snaps will attach to said second female snaps.

* * * * *